US007370578B2

(12) United States Patent
Bachmeir

(10) Patent No.: US 7,370,578 B2
(45) Date of Patent: May 13, 2008

(54) INKING OR DAMPENING UNIT INCLUDING ADJUSTABLE THROW-ON FORCE FOR SETTING IMPRINT WIDTH

(75) Inventor: Xaver Bachmeir, Haunswies (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 106 days.

(21) Appl. No.: 10/509,812

(22) PCT Filed: Apr. 3, 2003

(86) PCT No.: PCT/EP03/03455

§ 371 (c)(1),
(2), (4) Date: Sep. 30, 2004

(87) PCT Pub. No.: WO03/084754

PCT Pub. Date: Oct. 16, 2003

(65) Prior Publication Data

US 2005/0160931 A1 Jul. 28, 2005

(30) Foreign Application Priority Data

Apr. 8, 2002 (DE) ..... 102 15 422

(51) Int. Cl.
*B41F 31/32* (2006.01)

(52) U.S. Cl. ..... 101/351.3; 101/352.04; 101/148

(58) Field of Classification Search ..... 101/352.01, 101/351.3, 351.4, 352.04, 352.05, 351.1, 101/147, 148
See application file for complete search history.

(56) References Cited

U.S. PATENT DOCUMENTS

| | | | | | |
|---|---|---|---|---|---|
| 3,286,622 | A | * | 11/1966 | Luis | 101/218 |
| 3,507,215 | A | * | 4/1970 | Schuhmann | 101/148 |
| 3,688,694 | A | * | 9/1972 | Preuss et al. | 101/148 |
| 4,222,325 | A | * | 9/1980 | Edwards | 101/137 |
| 4,481,882 | A | * | 11/1984 | Rudolph | 101/148 |
| 4,523,522 | A | * | 6/1985 | Fischer | 101/219 |
| 5,142,977 | A | | 9/1992 | Gertsch et al. | |
| 5,152,220 | A | | 10/1992 | Lindner et al. | |
| 5,355,796 | A | | 10/1994 | Köbler et al. | |
| 5,448,949 | A | | 9/1995 | Bucher | |
| 5,485,785 | A | | 1/1996 | Schneider et al. | |
| 5,555,806 | A | * | 9/1996 | Nawrath | 101/148 |
| 6,098,542 | A | * | 8/2000 | Dufour | 101/352.05 |

FOREIGN PATENT DOCUMENTS

| | | |
|---|---|---|
| DE | 33 42 853 C2 | 12/1984 |
| DE | 38 25 517 C2 | 2/1990 |
| DE | 92 15 906.0 | 2/1993 |
| DE | 42 11 379 A1 | 10/1993 |
| DE | 44 27 967 A1 | 3/1995 |
| DE | 43 35 282 C2 | 4/1995 |
| DE | 197 30 681 A1 | 4/1998 |
| DE | 197 40 480 A1 | 3/1999 |
| DE | 100 23 605 A1 | 6/2002 |
| GB | 2 132 944 A | 7/1984 |

* cited by examiner

*Primary Examiner*—Leslie J. Evanisko
(74) *Attorney, Agent, or Firm*—Cohen Pontani Lieberman & Pavane LLP

(57) ABSTRACT

An inking or dampening unit includes an applicator roll mounted on levers so that the application roll can be pivoted about a distributor cylinder onto a form cylinder with a controlled throwing-on force.

12 Claims, 4 Drawing Sheets

18
4
19
2
5,6
7,8
(15)
3
M
(11)
17
16
B
12.1
12

22
2
5,6
7,8
3
4
19
1
17
16
B
12.1
12

18
4
19
2
5,6
7,8
(15)
3
M
(23)
17
16
B
12.1
12

INKING OR DAMPENING UNIT INCLUDING ADJUSTABLE THROW-ON FORCE FOR SETTING IMPRINT WIDTH

PRIORITY CLAIM

This is a U.S. national stage of application No. PCT/EP03/03455, filed on 3 Apr. 2003. Priority is claimed on that application and on the following application(s): Country: Germany, Application No.: 102 15 422.8, Filed: 8 Apr. 2002.

BACKGROUND OF THE INVENTION

1. Field of the Invention

The invention relates to an inking or dampening unit of a rotary press, having at least one applicator roll pivotally mounted on levers so that the applicator roll is pivotable onto a form cylinder of the rotary press.

2. Description of the Prior Art

GB 2132944 discloses an inking unit, in which an ink applicator roll can be pivoted about a distributor cylinder and can be thrown onto a form cylinder at the same time. The applicator roll is mounted on both sides in levers. Adjustable stops against which the levers can be moved serve to adjust the applicator roll on the form cylinder. A disadvantage is the complexity of the setting and subsequent adjustment of the stops.

SUMMARY OF THE INVENTION

It is an object of the invention to provide an inking or dampening unit which is distinguished by low setting and adjusting complexity of the applicator rolls.

In an inking or dampening unit of the generic type, the object is achieved according to the invention by the features of the independent patent claim. The applicator roll is thrown onto the form cylinder with a defined force by performing the throwing-on action with a controlled force. The contact force (reaction force) is in equilibrium with the throwing-on force and is automatically set. The contact force can be selected by varying the throwing-on force and it is thus easier to set what is known as the imprint width. The throwing-on action is not sensitive to positional deviations of the inking or dampening unit with respect to the form cylinder, as the applicator roll finds its equilibrium automatically by an appropriate pivoting movement. Subsequent adjustments can also be performed automatically in this way, for example in the event of swelling or shrinking of the applicator roll or changes in diameter as a result of thermal expansion.

The applicator roll can also follow limited movements of the form cylinder, for example the print throwing-on and throwing-off movement, while maintaining its setting.

The proposed throwing-on action also makes it possible to use form cylinders of different diameter, onto which the applicator roll can be thrown in a self-adjusting manner. As a result, it is no longer necessary to rebuild the inking or dampening unit if the format of the printing press is changed, and it is possible to realize a uniform inking and dampening unit configuration for a range of formats of form cylinders.

Further features and advantages emerge from the subclaims in conjunction with the description.

BRIEF DESCRIPTION OF THE DRAWINGS

The invention is to be explained in greater detail in the following text using an exemplary embodiment.

DETAILED DESCRIPTION OF THE PREFERRED EMBODIMENTS

Figure 1:
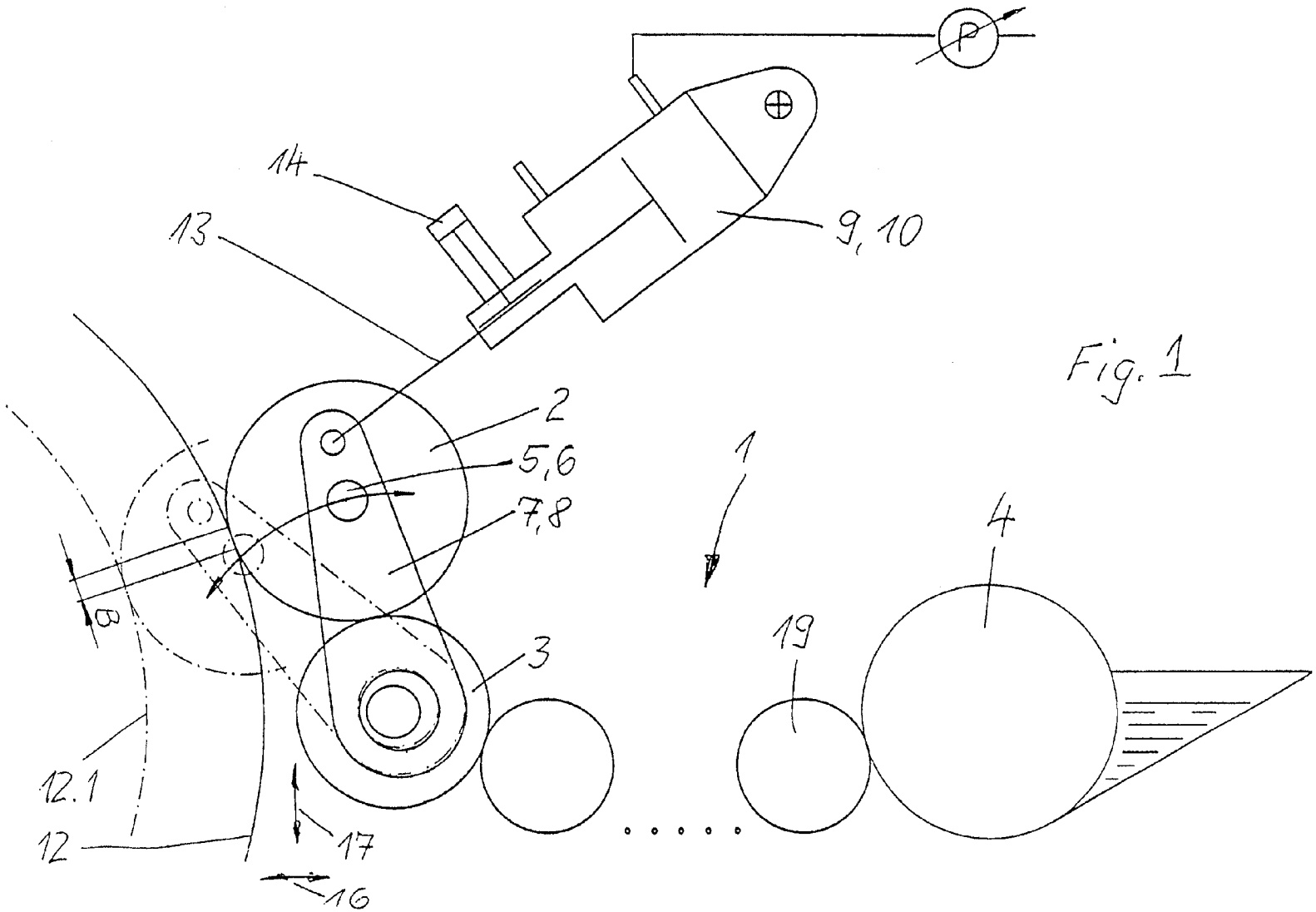
FIG. 1 diagrammatically shows an inking unit of a rotary press, having an applicator roll which can be thrown onto a form cylinder.

FIG. 1 shows an inking unit 1, of which only an applicator roll 2 and a distributor cylinder 3 are shown. Furthermore, a wedge-shaped ink fountain 4 is shown, by way of example, as the ink source, ink transport rolls 19 which are only indicated diagrammatically transporting ink from said ink fountain 4 to the distributor cylinder 3.

The applicator roll 2 is mounted at both ends with its journals 5, 6 in levers 7, 8. The levers 7, 8 can be pivoted about the rotational axis of the distributor cylinder 3. For this purpose, they are mounted, for example, on the journals of the distributor cylinder 3 or in side walls (not shown), in which the distributor cylinder 3 is also mounted.

Figure 2:
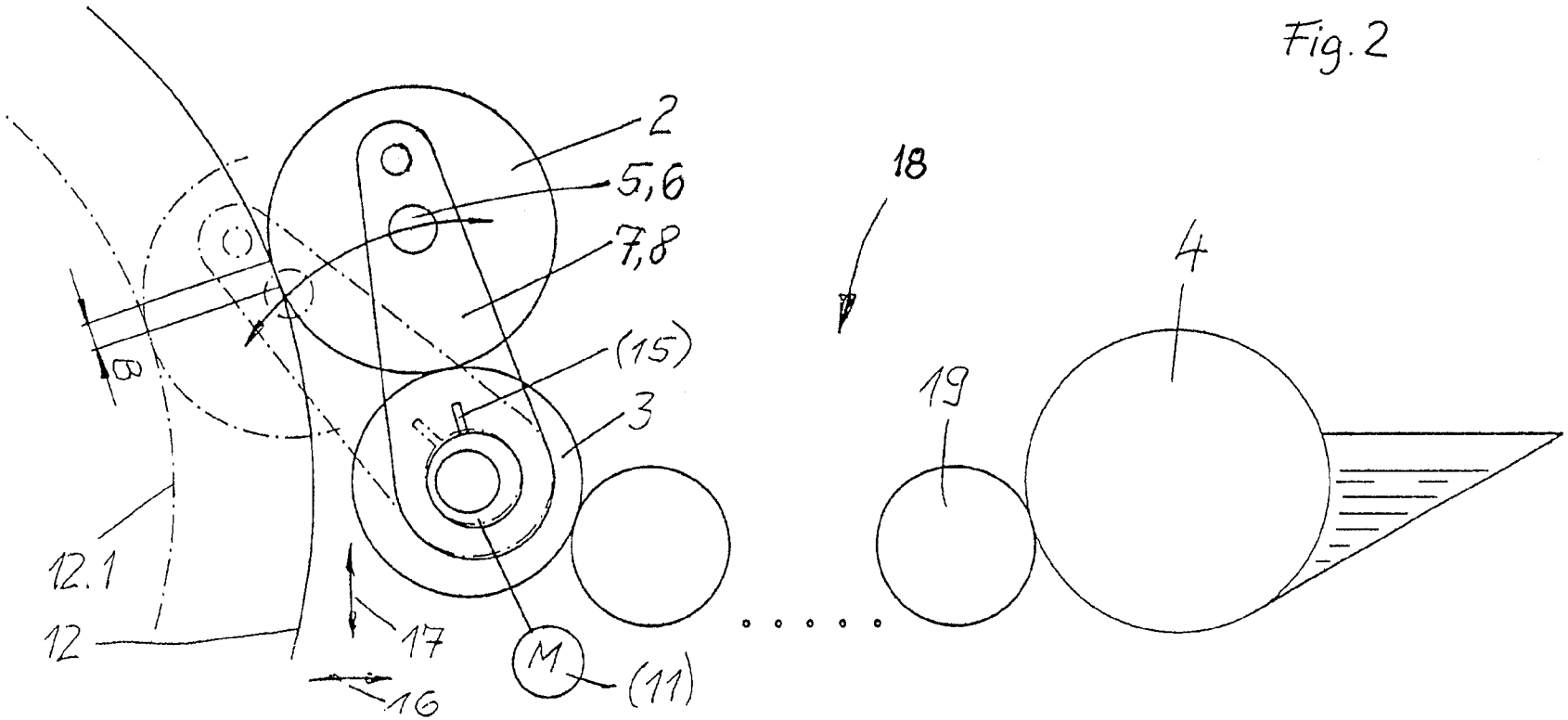
FIG. 2 diagrammatically shows a dampening unit of a rotary press having an applicator roll which can be thrown onto a form cylinder according to another embodiment.
Figure 3:
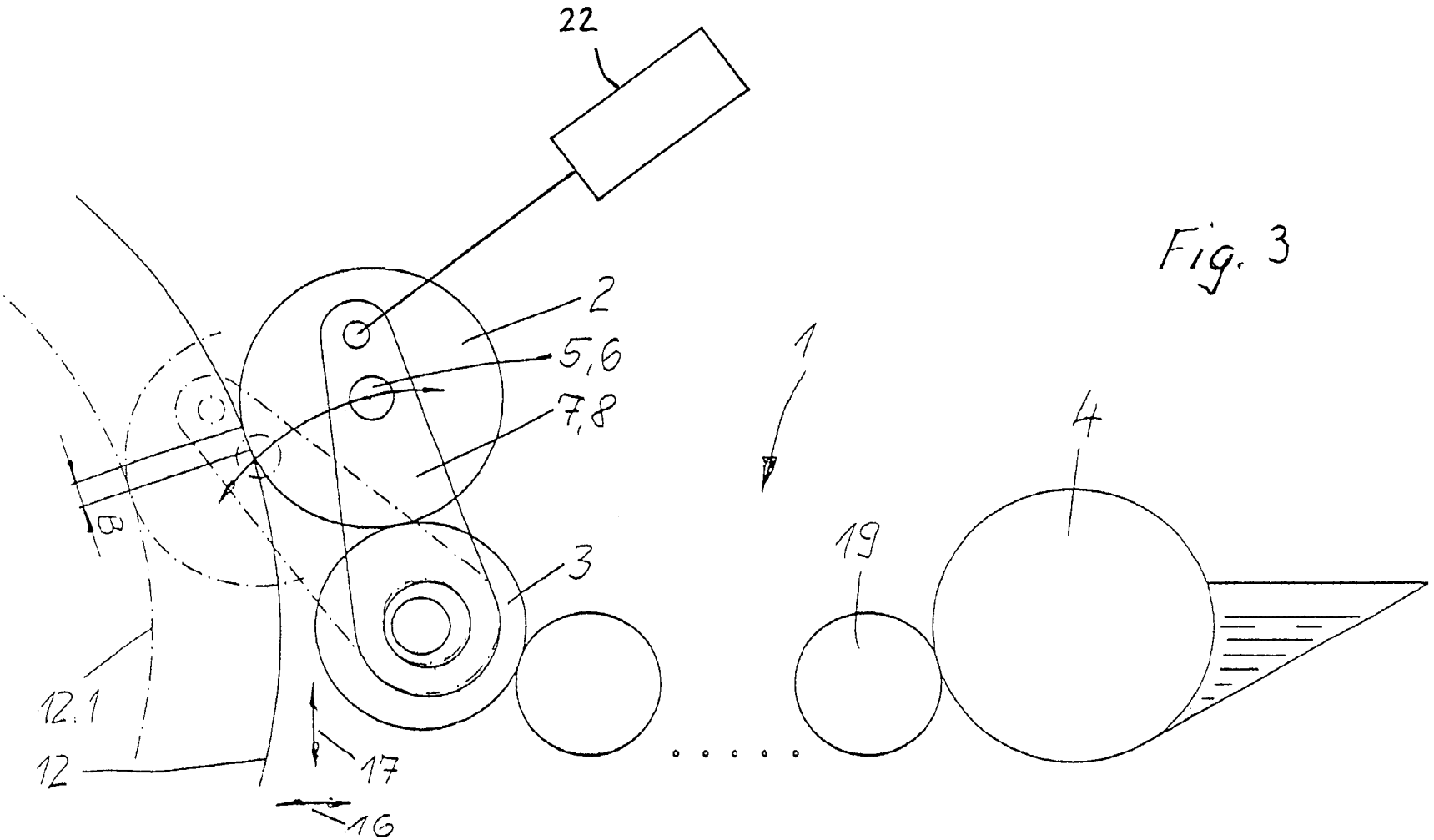
FIG. 3 diagrammatically shows a dampening unit of a rotary press having an applicator roll which can be thrown onto a form cylinder according to yet another embodiment.
Figure 4:
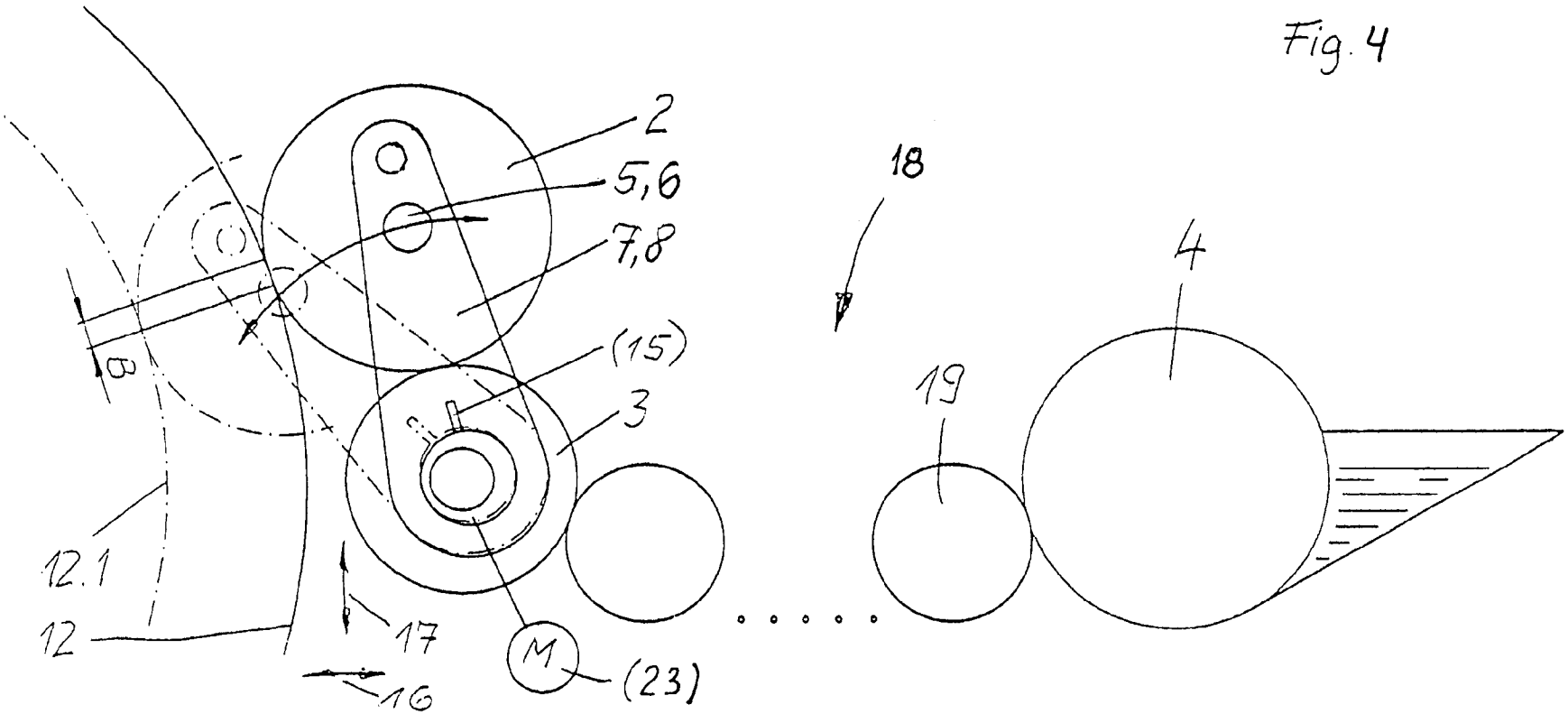
FIG. 4 diagrammatically shows a dampening unit of a rotary press having an applicator roll which can be thrown onto a form cylinder according to a further embodiment.

In each case one linear motor in the form of an operating cylinder 9, 10 acts in a pivotably mounted manner on the levers 7, 8. A spring or an electric attraction magnet, for example, could also be used as linear motor 22 as shown in FIG. 3. Instead of by means of operating cylinders 9, 10 or linear motor 22 the levers 7, 8 can also be acted on by means of a rotary motor, for example by means of an electric, pneumatic or hydraulic motor or in a manner based on spring force. A rotary motor 11 of this type is indicated in the dampening unit of FIG. 2 (discussed in more detail below) but may also be incorporated in the inking unit of FIG. 1. As mentioned above, the rotary motor may be based on a spring force, such as the rotary spring motor 23 shown in FIG. 4.

The applicator roll 2 can be pivoted against a form cylinder 12 by pivoting the levers 7, 8. For this purpose, a fluid, preferably compressed air, is supplied to the operating cylinders 9, 10 at a selected pressure p, the piston rods 13 of said operating cylinders 9, 10 extending and the levers 7, 8 moving into the drawn position together with the applicator roll 2. The pressure p is selected here in such a way that the throwing-on force which acts on the levers 7, 8 produces a contact force which brings about the desired imprint width B of the applicator roll 2 on the form cylinder 12. Subsequently, the position of the applicator roll 2 is locked by means of a locking apparatus 14. Instead of this, locking apparatuses 15 as shown in FIG. 2 may alternatively be arranged on the levers 7, 8.

The locking apparatus 14 can also be released temporarily during continuous printing, as a result of which the thrown-on position of the applicator roll 2 is subsequently adjusted automatically, that is to say the levers 7, 8 are thrown on further or moved back in the event, for example, of a swollen or shrunk applicator roll 2 or a change in diameter as a consequence of thermal expansion. It is also possible to operate the inking unit 1 without locking the thrown-on position of the applicator roll 2, as a result of which automatic subsequent adjustment is performed constantly. After it has been thrown onto the form cylinder 12, it is also possible to operate the applicator roll 2 initially at a defined speed during the running-in period of the inking unit 1 and without locking its position for a defined time period. As a result, the applicator roll 2 can, for example, yield to initial imbalances due to non-uniform color distribution. Advantageously, the applicator roll 2 is initially thrown on with a higher throwing-on force compared with later operation, in that the operating cylinders 9, 10 are fed initially at a higher pressure p. As a result, throwing-on actions which are too brief as a consequence of static friction are avoided.

In a further design variant, it is also possible to displace the inking unit 1 in the direction 16 toward the form cylinder 12 after the applicator roll 2 has been thrown onto the form cylinder 12 and this position has been locked. This procedure also compensates for the throwing-on actions which are too brief as a consequence of static friction.

It is also possible to throw the applicator roll 2 onto the form cylinder 12 situated in the print thrown-off position, to lock this position, and to move the form cylinder 12 into the print thrown-on position in the direction 17 and in the process to move the inking unit 1 simultaneously in the direction 17. Means for moving an inking unit are disclosed in U.S. Pat. No. 6,502,509, the entire contents of which are expressly incorporated herein by reference.

The applicator roll 2 can also be a dampening solution applicator roll of a dampening unit 18 as shown in FIG. 2. Similarly, the other rolls in FIG. 1 may also be used in the dampening unit of FIG. 2. As described above, the levers may be moved using a rotary motor 11. Instead of the rotary motor 11, operating cylinders 9, 10 may be used as described above with respect to FIG. 1. If the operating cylinders 9,10 are implemented, the locking unit 14 may be used as an alternative to the locking unit 15.

The applicator roll 2 can also be a dampening solution applicator roll of a dampening unit 18 (denoted with an item number in brackets).

What is claimed is:

1. An applicator unit for one of inking and dampening in a rotary press having a form cylinder, the applicator unit comprising:

a distributor cylinder having an axis of rotation;

an applicator roll having two ends, said two ends being mounted in respective levers such that said applicator roll is pivotable about the axis of rotation of said distributor cylinder by said levers;

a motor operatively arranged for pivoting said applicator roll such that applicator roll is pivotable to a thrown-on position against the form cylinder of the rotary press with a controlled throwing-on force by said motor, wherein said applicator roll contacts the form cylinder in an imprint area when said applicator roll is in the thrown-on position, the imprint area having a length along a length of said applicator roll and an imprint width along a circumferential direction of said applicator roll, said throwing-on force is adjustable to set a desired imprint width, said motor comprising one of a spring, an electric attraction magnet, or a rotary motor acting on said levers; and a lock mechanism for locking said applicator roll in the thrown-on position.

2. The applicator unit of claim 1, wherein said motor is operable for applying an initial throwing-on force when pivoting said applicator roll toward the thrown-on position that is greater than an operating throwing-on force that is applied after said applicator roll is in said thrown-on position.

3. The applicator unit of claim 1, wherein said motor is operable for applying a variable throwing-on force in response to various reaction effects on said applicator roll during operation in the thrown-on position.

4. The applicator unit of claim 1, wherein said lock mechanism is arranged and dimensioned for acting directly on said motor for holding said motor at a fixed position for locking said applicator roll in the thrown-on position.

5. The applicator unit of claim 1, wherein said lock mechanism is arranged and dimensioned for acting directly on said levers for holding said levers at a fixed position for locking said applicator roll in the thrown-on position.

6. The applicator unit of claim 1, wherein said lock mechanism is operable for locking said applicator roll one of immediately after the thrown-on position is reached and after a running-in period after reaching the thrown-on position has elapsed.

7. The applicator unit of claim 1, wherein said applicator unit is movably mountable so that a position of said applicator unit is adjustable relative to the form cylinder in the rotary press when said applicator roll is locked in said thrown-on position.

8. The applicator unit of claim 1, wherein said applicator unit is mountable such that said applicator roll is movable with the form cylinder from a print throw-off position of the form cylinder to a print throw-on position of the form cylinder when said applicator roll is locked in said thrown-on position.

9. The applicator unit of claim 1, wherein said motor is operatively arranged for pivoting said applicator roll such that applicator roll is pivotable to different thrown-on positions against form cylinders having different diameters.

10. The applicator unit of claim 1, wherein said motor comprises a rotary motor acting on the levers at a position proximate the axis of rotation of said distribution roller.

11. The applicator unit of claim 1, wherein said motor comprises a rotary motor comprising a spring force.

12. The applicator unit of claim 1, wherein said motor comprises an electric attraction magnet.

* * * * *